US009387153B1

(12) United States Patent
Mazur

(10) Patent No.: US 9,387,153 B1
(45) Date of Patent: Jul. 12, 2016

(54) METERED DISPENSING SYSTEM

(71) Applicant: Robert G. Mazur, Louisville, KY (US)

(72) Inventor: Robert G. Mazur, Louisville, KY (US)

( * ) Notice: Subject to any disclaimer, the term of this patent is extended or adjusted under 35 U.S.C. 154(b) by 44 days.

(21) Appl. No.: 14/309,188

(22) Filed: Jun. 19, 2014

Related U.S. Application Data

(60) Provisional application No. 61/956,871, filed on Jun. 19, 2013.

(51) Int. Cl.
*B65D 83/04* (2006.01)
*A61J 7/00* (2006.01)
*A61J 7/04* (2006.01)

(52) U.S. Cl.
CPC ..... *A61J 7/0069* (2013.01); *A61J 7/0409* (2013.01); *B65D 83/0445* (2013.01)

(58) Field of Classification Search
CPC ..... B65D 83/04; B65D 83/0445; B65D 83/0463; B65D 83/0481; B65D 83/049; A61J 7/0069; A61J 7/0409; A61J 7/0445
USPC ..... 221/197
See application file for complete search history.

(56) References Cited

U.S. PATENT DOCUMENTS 2,412,332 A * 12/1946 Hansen ..... B65D 25/04 206/315.11
3,286,390 A * 11/1966 Guice ..... A01K 97/06 43/57.1
3,820,655 A 6/1974 La Tourette et al.
4,057,145 A * 11/1977 Wray ..... B65D 83/0445 206/538
4,660,991 A 4/1987 Simon
4,763,810 A * 8/1988 Christiansen ..... A61J 7/0481 221/15
5,046,455 A * 9/1991 Christiansen ..... A01K 5/0291 119/56.1
5,203,472 A * 4/1993 Levenbaum ..... A24F 15/005 131/270
5,724,764 A * 3/1998 Alsup ..... A01K 97/06 220/525
6,471,063 B2 10/2002 Stepp
6,594,549 B2 7/2003 Siegel
7,048,141 B2 5/2006 Abdulhay et al.
7,178,688 B2 2/2007 Naufel et al.
7,359,765 B2 4/2008 Varvarelis et al.
8,146,627 B2 4/2012 Mazur
8,264,335 B2 9/2012 Dehlin et al.
D686,407 S 7/2013 Mazur
8,581,709 B2 11/2013 Mazur
2004/0158350 A1* 8/2004 Ostergaard ..... A61J 7/0481 700/231
2009/0127275 A1 5/2009 Choi et al.
2009/0277921 A1 11/2009 Angelucci et al.
2009/0299522 A1 12/2009 Savir et al.
2010/0000899 A1 1/2010 Burg et al.
2011/0196538 A1* 8/2011 Michael ..... E05B 47/00 700/275
2013/0066463 A1 3/2013 Luoma et al.
2013/0319902 A1 12/2013 Tufi

* cited by examiner

*Primary Examiner* — Patrick Mackey
(74) *Attorney, Agent, or Firm* — Middleton Reutlinger

(57) ABSTRACT

Apparatus and methods relating to a metered pill dispensing system are disclosed herein. A preloaded cartridge having multiple compartments containing dispensable contents, such as pills, is inserted into a cassette. The cassette has an actuatable member, such as a film or a belt, wrapped around it. The actuatable member has apertures through which the contents of the preloaded cartridge may pass. The actuatable member may be controlled to meter the dispensing of the contents.

15 Claims, 6 Drawing Sheets

METERED DISPENSING SYSTEM

CLAIM OF PRIORITY

This application, under 35 USC §119(e), claims the benefit of and priority to U.S. Provisional Application Ser. No. 61/956,871, filed on Jun. 19, 2013, entitled "Dispenser and Cartridge."

CROSS-REFERENCE TO RELATED APPLICATIONS

None.

TECHNICAL FIELD

Generally, a dispensing system is taught. More specifically, a dispensing system for receiving a cartridge and dispensing contents therefrom is taught.

BACKGROUND

It is often necessary or desirable to package items or objects and/or to dispense them in an organized or controlled manner. For example, certain medical conditions or ailments call for certain medication(s) or treatment regimen(s), which may include a variety of pills or medications that are to be taken in certain combination and/or at certain times (e.g., daily, twice per day, every other day, etc.). It can become difficult for a person or patient to keep track of and/or remember what pills or medications (or other items) to take, and at what time to take them.

Attempts have been made to help individuals organize and/or use certain items at certain times of day. For example, compartmentalized pillboxes have been developed that contain multiple doses to be taken at different times. However, such devices still require a person or individual to fill them, and to remember to take them at certain times.

Thus there is a need in the art for overcoming the issues of existing systems.

The information included in this Background section of the specification, including any references cited herein and any description or discussion thereof, is included for technical reference purposes only and is not to be regarded subject matter by which the scope of any embodiment or claim is to be bound.

SUMMARY

The present disclosure is directed towards methods and apparatus for a metered pill dispensing system. The metered pill dispensing system is, in various embodiments, a system that receives a pre-loaded pill cartridge or tray, containing a pre-determined or individualized assortment and compartmentalization of pills, designed for a particular person's medication regimen. The multiple compartments of the tray may each contain a dose of medication, for example, as prescribed if prescription medication is involved. The pre-loaded tray can be inserted into a cassette that aids in the metered dispensing of pills from the tray. The cassette may have an actuatable, indexing film wrapped around it, with the film having one or more openings in it through which pills may pass. Actuation or indexing of the film may cause the openings to align with certain compartments of the tray. Furthermore, actuation or indexing of the film may be controlled (e.g., by an electronic or mechanical device) so that the pill(s) of a given compartment are released or dispensed at a certain, predetermined day and/or time of day.

Generally, in one aspect, a metered dispenser is provided having a cassette and a housing. The cassette is sized and shaped to internally receive a predetermined multi-compartment cartridge, each compartment of the cartridge may retain one or more predetermined objects. The cassette may be received in the housing. An actuatable film may be attached to and wrapped around the cassette. The film has one or more film apertures through which at least one of the predetermined objects may pass. The film is actuatable between a closed position, a first open position, and a second open position. In the first open position, the film aperture(s) may align with a first compartment(s) of the cartridge while the cartridge is in the cassette. In the second open position, the film aperture(s) may align with a second compartment(s) of the cartridge while the cartridge is in the cassette. The cassette includes a first actuatable member that causes actuation of the film between the closed position, the first open position, and the second open position. The housing includes a second actuatable member that causes actuation of the first actuatable member.

Optionally, in some embodiments, the first actuatable member may be in communication with a timer to automatically actuate the film. The housing may include an angled surface to direct the predetermined object toward an accessible area. The housing may include a scale for measuring and communicating the weight of the predetermined objects. An indication may be made if the weight of the predetermined object(s) differ(s) from a predetermined target weight. The predetermined objects may be or may include pills. One or both of the actuatable members may be wheels and, if both are wheels, they may be cooperating wheels. The cassette and/or the housing may include a recessed area for receiving the predetermined objects. If included, the recessed area may include a funnel. The cassette may include a door that may be opened and closed to receive and retain the cartridge, respectively. The first actuatable member and/or the second actuatable member may be in communication with a control. The control, if included, may be in communication with a mobile device having a user interface for causing actuation of the first actuatable member via the control. The cartridge may include a readable identifier that identifies the contents of the cartridge, and/or the readable identifier may be in communication with (or communicated to) the control and/or the mobile device. The mobile device, if included, may be a cell phone and/or a tablet device. A camera may be included for reading the readable identifier of the cartridge and communicating it to the control and/or the mobile device.

Generally, in another aspect, a method of dispensing contents of a preloaded cartridge is taught. The method includes the step of providing the preloaded cartridge, which includes a plurality of compartments as well as an identifier. Each compartment includes dispensable contents. The cartridge is inserted into a cassette that has an actuatable member wrapped around it, and the actuatable member (e.g., film or belt) has at least one aperture through which the dispensable contents of the cartridge may pass. The cassette is connected to the housing and the actuatable member of the cassette is actuated. Some or all of the dispensable contents are dispensed through the aperture(s) in the actuatable member.

Optionally, the dispensed contents may be weighed with a scale. The identifier of the cartridge may be communicated to a control and/or a mobile device. If so, the actuatable member may be activated based on the identifier that is communicated to the control and/or mobile device for metered dispensing of the dispensable contents.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of any present embodiment is provided in the following written description of various embodiments, illustrated in the accompanying drawings, and defined in the appended claims.

BRIEF DESCRIPTION OF THE DRAWINGS

In the drawings, like reference characters generally refer to the same parts throughout the different views. Also, the drawings are not necessarily to scale, and emphasis instead is generally placed upon illustrating the principles of the embodiments depicted.

DETAILED DESCRIPTION

Figure 1:
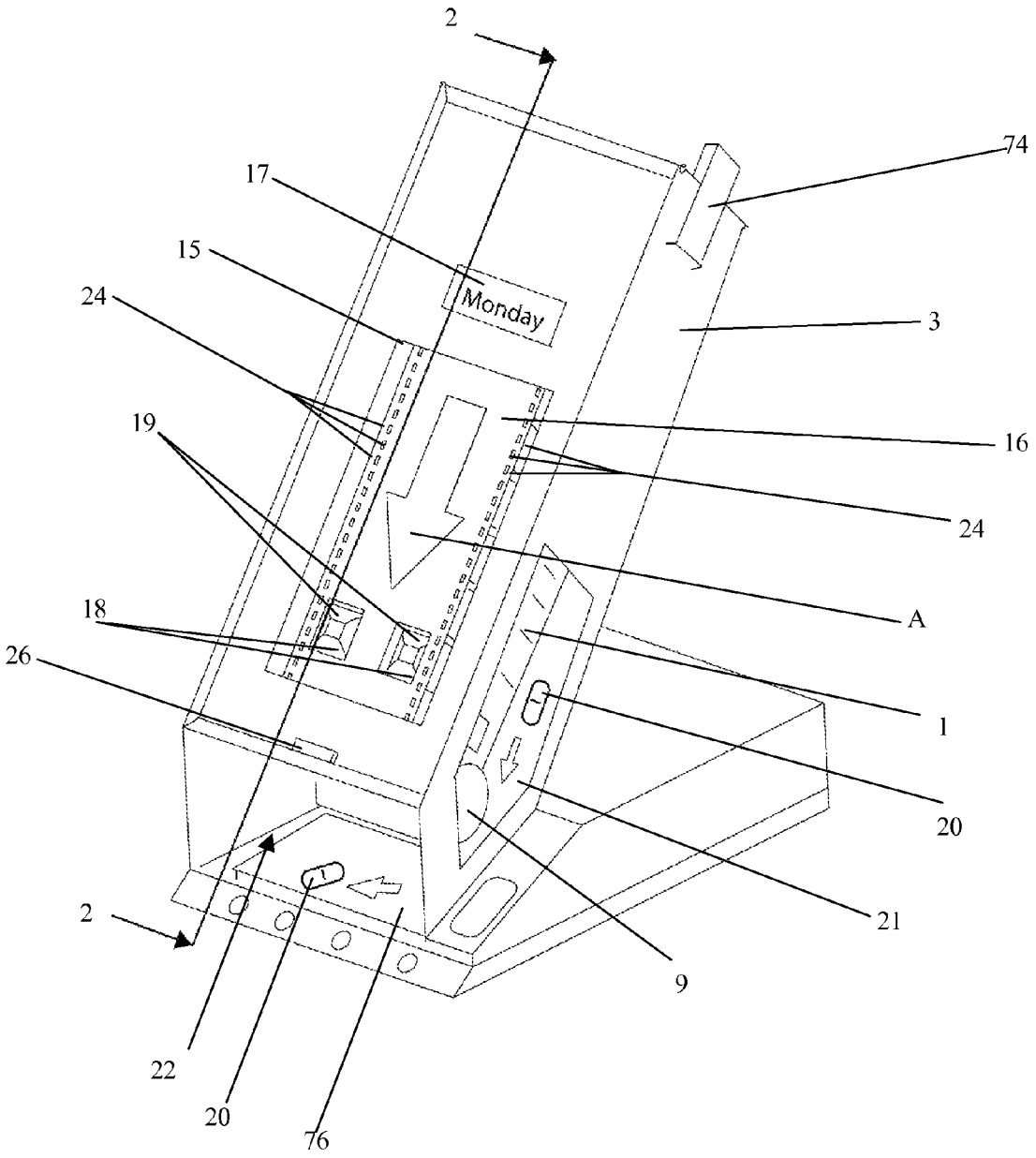
FIG. 1 is a perspective view of an embodiment of a metered pill dispensing system.

It is to be understood that the embodiments are not limited in their application to the details of construction and the arrangement of components set forth in the following description or illustrated in the drawings. Other embodiments are possible and may be practiced or carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected" and "coupled" and variations thereof herein are used broadly and encompass direct and indirect connections and couplings. In addition, the terms "connected" and "coupled" and variations thereof are not restricted to physical or mechanical connections or couplings.

Figure 2:
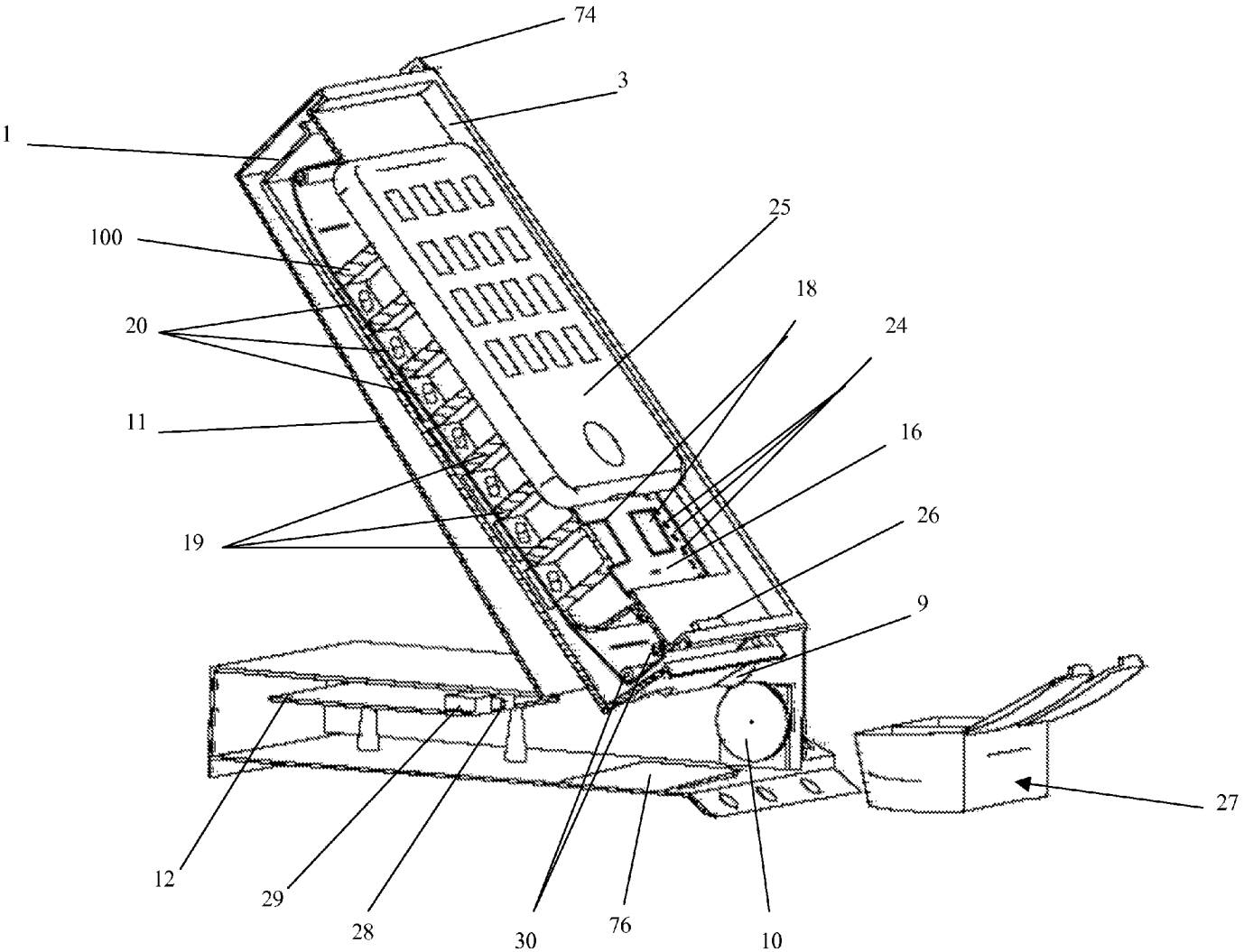
FIG. 2 is a section view of the metered pill dispensing system of FIG. 1 taken along line 2-2.

Referring initially to FIGS. 1 and 2, an embodiment of a dispenser or housing (3) is depicted with an embodiment of a cassette (1) coupled thereto. Cassette (1) may include a preloaded, multi-compartment cartridge (100), which may be preloaded with contents (20). Each compartment (8) or tower (19) of cartridge (100) may contain one or more unit of contents (20). Contents (20) may include any of a variety of objects or things, including, but not limited to, pills, medications, candy, or the like, or any combination thereof, without limitation. Insofar as the terms pill and/or pillbox, or the like, are referred to herein, such references are for convenience only and do not limit the embodiments or the claims to include or to be used with or for pills. Cassette (1) may include an actuatable member, such as a belt or film (16), which may be wrapped around cassette (1) and/or be actuated or moved so that it rotates or moves around cassette (1). Film (16) may include one or more openings or apertures (18), which may be sized, shaped, and/or located so that they may be aligned with compartments (8) to, for example, allow contents (20) of compartments (8) to exit towers (19) and/or cassette (1).

Film (16) may be actuated so that it moves, for example, in direction A. Apertures (18) may align with a first compartment (8) or a first row or first set of compartments (8), and then be actuated or moved until aligned with a second compartment (8) or a second row or second set of compartments (8). Thus, for example, film (16) may be rotated between any or all of a closed position in which apertures (18) are not aligned with compartments (8) so that contents (20) are retained in cartridge (100) by film (16), a first open position in which aperture(s) (18) are aligned or alignable with a first compartment (8) or first set of compartments (8), and a second open position in which aperture(s) (18) are aligned or alignable with a second compartment (8) or second set of compartments (8). Actuation or movement of film (16), for example, in direction A, or otherwise, may cause film (16) and/or aperture(s) (18) to move or cycle between the closed position, the first open position, and/or the second open position.

Film (16) may be actuated in any of a variety of ways, including, but not limited, by actuation or rotation of a first actuatable member or wheel (9). For example, first wheel (9) may be caused to rotate by hand or by any other actuating member, and/or rotation of first wheel (9) may cause rotation, translation, and/or movement of film (16) such as, for example, in direction A. It is understood that an intermediary member may be actuated by first wheel (9) or other actuating member to cause rotation, translation, and/or movement of film (16), such as, for example, one or more spools (30). In some embodiments, film (16) may include and/or have attached thereto registration holes (24) that engage or communicate with teeth of spools (30). It may be appreciated that use of registration holes (24) in conjunction with teeth, projections, or a gripping surface of spools (30) may allow precise movement of film (16), as a certain amount of rotation of spools (30) will result in a predetermined and/or controlled amount of movement in direction A, without much unwanted or uncontrolled motion of film (16) relative to spools (30) (such as back sliding, for example). It is further understood that direction A may be in substantially the direction shown in the figures, in the opposite direction, and/or in any direction transverse thereto.

Housing (3) may include, be connected to, coupled with, and/or attached to a second actuating member or wheel (10) and/or electronic or automated components for controlling actuating wheel (10). It is understood that second actuating member (10) is not limited to wheel or wheel-like embodiments. However, using a second actuating wheel (10) may be useful when first actuating member (9) is a wheel. For example, first actuating wheel (9) and second actuating wheel (10) may include cooperating gear teeth and/or cooperating friction surfaces, so that rotating of second actuating wheel (10) may cause rotation of first actuating wheel (9), or vice versa. It is understood that actuation of first actuating member (9) and/or second actuating member (10) may be mechanical, such as by use of gear teeth, friction surfaces, other mechanical mechanisms or methods, or any combination thereof, and/or may include actuating mechanisms that are non-mechanical instead of, or in addition to, mechanical actuation mechanisms. For example, first actuating member (9) may be actuated electrically, electronically, magnetically, electromechanically, by any other mechanism, and/or by any combination thereof. Moreover, first actuating member (9) may be actuated with or without second actuating member (10).

In some embodiments, any or all of first actuating member (9), second actuating member (10), spools (30), and film (16), whichever happen to be present in these embodiments, may be actuated, controlled, and/or in communication with electric or electronic devices. For example, a circuit board or control (12) may be in communication with second actuating member (10) and/or may cause actuation, rotation, and/or motion of second actuating member (10). Control (12) may be in communication with an external or mobile device (25). Control (12) may receive commands, inputs, and/or instructions from mobile device (25), so that mobile device (25) influences and/or controls the actuation of second actuating member (10) and/or first actuating member (9), and eventually the rotation of film (16) and consequently the dispensing of contents (20). For example, control (12) may include and/or be in communication with a timer, which may be set or programmed to automatically advance any or all of second actuating member (10), first actuating member (9), and/or film (16). Control (12) may also provide feedback to mobile device (25), which in turn may provide information to a user regarding the dispensing (e.g., time and/or amount of contents (20) dispensed). It is understood that electronics such as control (12) and/or mobile device (25) are not required and, in some embodiments, some or all actuation may be other than electric or electronic, such as mechanical or electro-mechanical, including, but not limited to use of, for example, turn wheels (e.g., manual turn wheels), wind-up motor(s), electrical motor(s) such as stepper motor(s), or the like, or any combination thereof. It is further understood that any or all communication between or within any component or feature of the metered dispensing system may be wireless and/or include wireless circuitry and/or components.

In some embodiments, mobile device (25) may be hardwired to control (12) and/or housing (3), for example, via connector (26). Mobile device (25) may communicate wirelessly with control (12) instead of or in addition to via connector (26) or the like, for example, via wireless receiver or transceiver (28). Wireless transceiver (28) may for example communicate with mobile device (25) via infrared, radio waves, Bluetooth®, RFID, optics, or the like. Optionally, housing (3) may include a charger (29), which may, for example, provide electricity or energy to any or all electric or electronic components, such as, for example, mobile device (25) (e.g., to charge its battery), control (12), transceiver (28), a camera (74), a scale (76) (camera (74) and scale (76) discussed in more detail below), any other component, or any combination thereof. Any or all of these components (including charger (29)) may be battery powered and/or externally powered, without limitation.

Contents (20) may exit cassette (1), for example, when aperture(s) (18) align with compartment(s) (8), and gravity or other force causes contents (20) to fall out of compartment(s) (8) and/or tower(s) (19) and onto angled surface (21) of housing (3). In these or other embodiments, cartridge (100) and/or cassette (1) may be placed into housing (3) at least partially upside down or inverted so that contents (20) tend to fall out of compartments (8) and/or towers (19) when aligned with apertures (18), with contents (20) being retained in compartments (8) by film (16). Thus, in such embodiments, causing alignment of apertures (18) with compartments (8) may cause dispensing of contents (20) as desired or controlled.

Angled surface (21) may be inclined so that contents (20) are (gently) slid from cassette (1) to accessible area (22), with little or no impact from falling. It is understood that the partial vertical orientation of housing (3) and/or cassette (1) is exemplary, and that any of a variety of orientations may be used without limitation, such as, for example, horizontal, vertical, any orientation therebetween, or any combination thereof. An angled gravity feed is merely one example of an orientation that may be employed. Scale (76) may be used, for example, to examine, observe, and/or weigh contents (20) that are dispensed. In some embodiments, scale (76) may communicate with control (12), mobile device (25), or other component or combination thereof to, for example, verify that the right dosage of contents (20) has been dispensed (e.g., if contents (20) are pills or medication). The right dosage may be a target dosage, which may be programmed or set to make it known whether the dispensed contents (20) are the right amount, type, etc.

In some embodiments, a container or pillbox (27) may be provided to, for example, hold dispensed contents (20). For example, pillbox (27) may be placed in accessible area (22) and/or on scale (76) so that, upon dispensing of contents (20) (e.g., a daily dosage of medication), contents (20) may be taken with a user without the need to transport housing (3), cassette (1), and/or cartridge (100). In some embodiments, either or both of window (15) and display (17) may be used to, for example, allow observation of cassette (1) and/or film (16) (or any other component or any combination thereof), or to display information, such as the day (e.g., "Monday" as shown in FIG. 1) or time, or any other information or any combination thereof.

Figure 3:
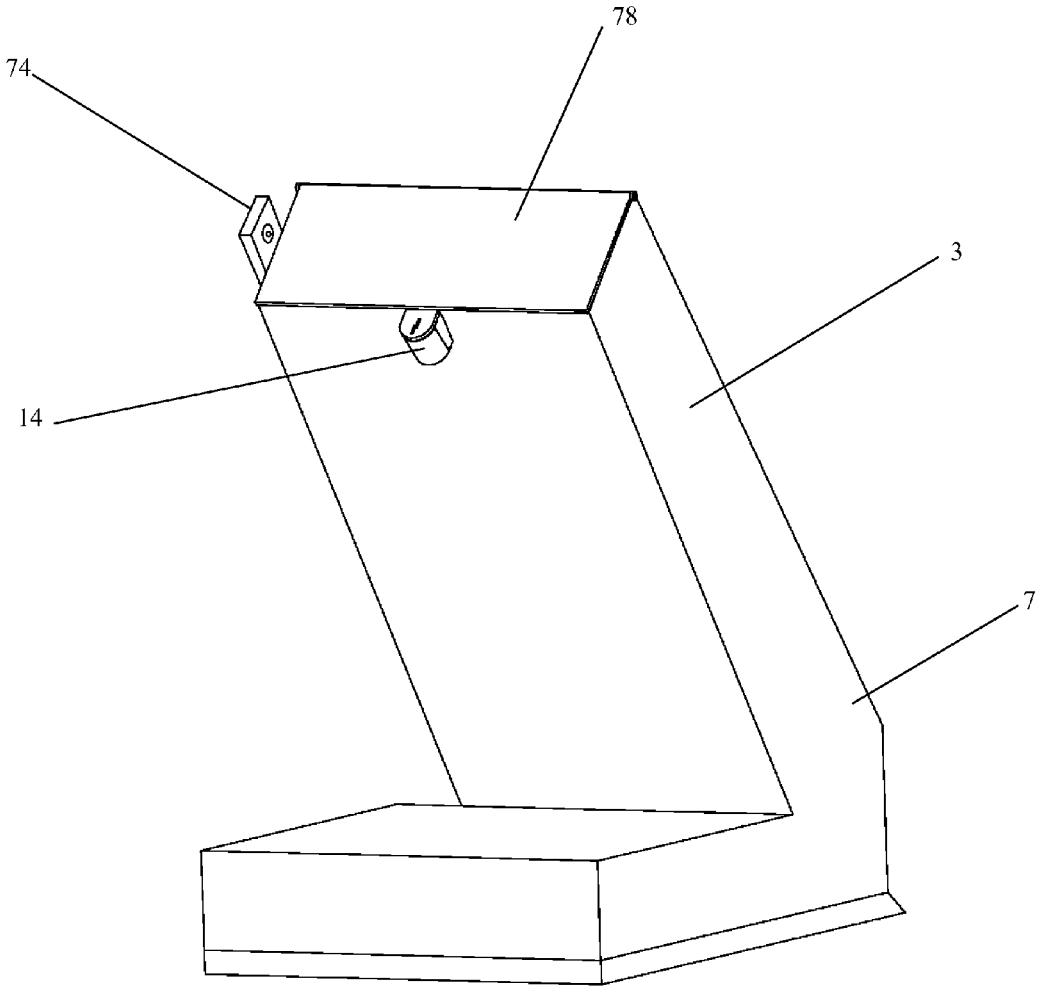
FIG. 3 is a rear perspective view of an embodiment of a metered pill dispensing system.
Figure 4:
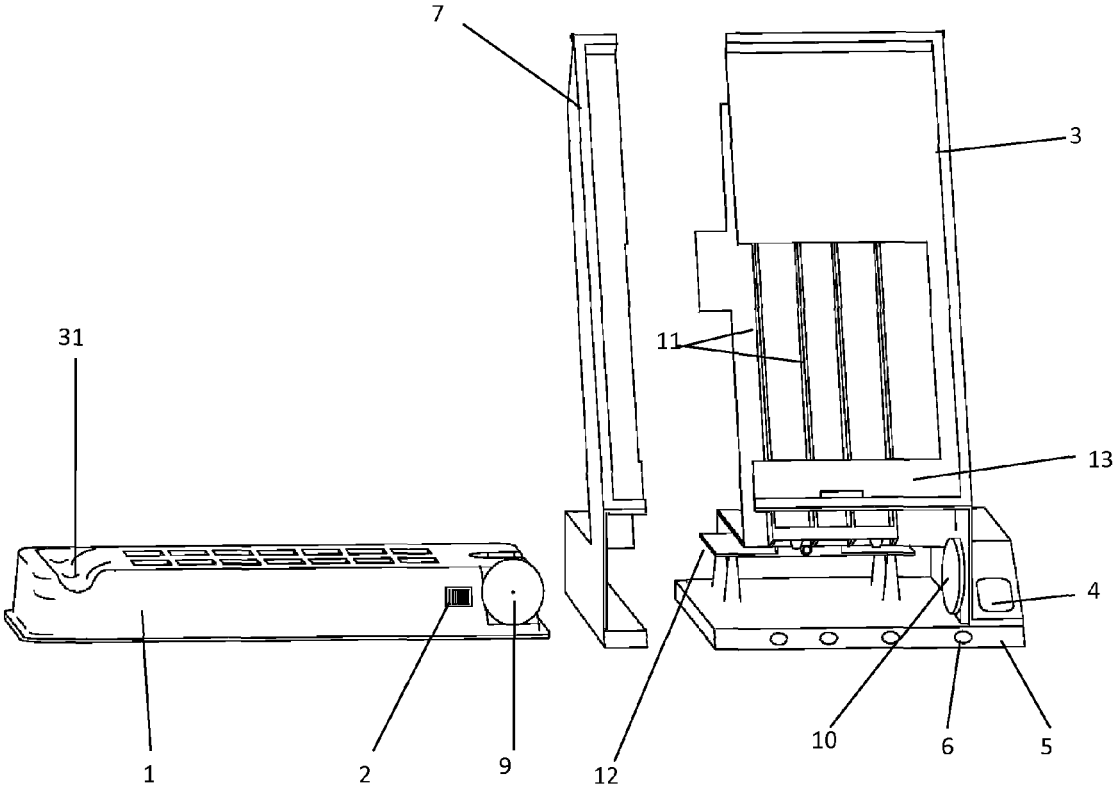
FIG. 4 is a perspective view of an embodiment of a metered pill dispensing system with an extending member and a cassette.

Referring now to FIGS. 3 and 4, various embodiments illustrate how housing (3) may accommodate and/or receive cassette (1) and/or cartridge (100). Housing (3) may include a separable or extending portion (7), which may slide and/or detach from the rest of housing (3) and/or may slide back toward and/or attach or re-attach to the rest of housing (3). This provides one exemplary embodiment facilitating insertion of cassette (1) and/or cartridge (100) into housing (3) and/or receiving area (13) of housing (3). Instead of or in addition to housing (3) including and/or connecting to a movable and/or separable portion such as extending portion (7), housing (3) may include a door (78) to facilitate inserting and/or removing cassette (1) and/or cartridge (100) from housing (3). Although shown in FIG. 3 as being at or near the top of housing (3), it is understood that door (78) may be located at any of a variety of locations on housing (3), or may be omitted (e.g., an opening without a door may provide access to housing (3) through which cassette (1) and/or cartridge (100) may be inserted and/or removed). If door (78) is included, a latching or locking mechanism (14) may be included to, for example, restrict access to housing (3) and/or restrict access to cassette (1) and/or cartridge (100), which may be in housing (3).

Further security measures may also be included. For example, a security device (4) may be included, which may, for example, be a biometric scanner such as a finger print scanner, etc. to restrict and/or prevent undesired access to housing (3), cassette (1), cartridge (100), and/or contents (20), for example. A control panel (5) and/or user inputs or buttons (6) may also be provided for any of a variety of reasons. For example, control panel (5) and/or buttons (6) may be a security device restricting access to housing (3), cassette (1), cartridge (100), and/or contents (20), etc., or they may provide a way for a user to actuate any component of the dispensing system, such as first wheel (9), second wheel (10), and/or film (16) for example (e.g., to cause and/or manually override any electronic controls to dispense some or all of contents (20)). It is understood that these are merely examples and control panel (5) and/or buttons (6) may be included for any of a variety of reasons or combination thereof, and that the inclusion of either or both of these features is optional.

Housing (3) and/or receiving area (13) may include guides (11), in some embodiments. Guides (11), if included, may keep the contents (20) coming from one compartment (8) separate from the contents (20) of another compartment (8). For example, cassette (1) and/or cartridge (100) include compartments (8) that are side by side and/or separated by guides (11) when connected to housing (3). The contents (20) of multiple side by side compartments (8) may be released from cassette (1) and/or cartridge (100) simultaneously such as might be desired, for example, when multiple doses of contents (20) are to be taken throughout the day and all are dispensed at one time into a subdivided pillbox (27) (wherein each compartment of the pillbox (27) might contain a separate dose for a separate time of day. In some embodiments, cassette (1) and/or cartridge (100) may include a recessed area (31), which may facilitate, for example, collecting, catching, and/or dispensing contents (20).

Cassette (1) and/or cartridge (100) may include a readable identifier or a barcode (2), which may, for example, identify the contents (20) contained in cassette (1) and/or cartridge (100), and/or identify the location of the contents (20) within any or all compartments (8). Camera (74) or another detecting or sensing device may be included to read the readable identifier such as barcode (2). In some embodiments, camera (74) may be located such that barcode (2) passes closely by and/or facilitates scanning or detecting of barcode (2). The information provided by the scanning of barcode (2) by camera (74) may be communicated to any or all electric, electronic, or other components, such as, for example, control (12) and/or mobile device (25). The information provided may be used to, for example, provide a user with certain information (e.g., via a user interface or visual display of mobile device (25), display (17) of housing (3) shown in FIG. 1), or other output for the user's observing), and/or to provide control (12) and/or mobile device (25) (or any other component) with commands, instructions, information, etc.

Figure 5:
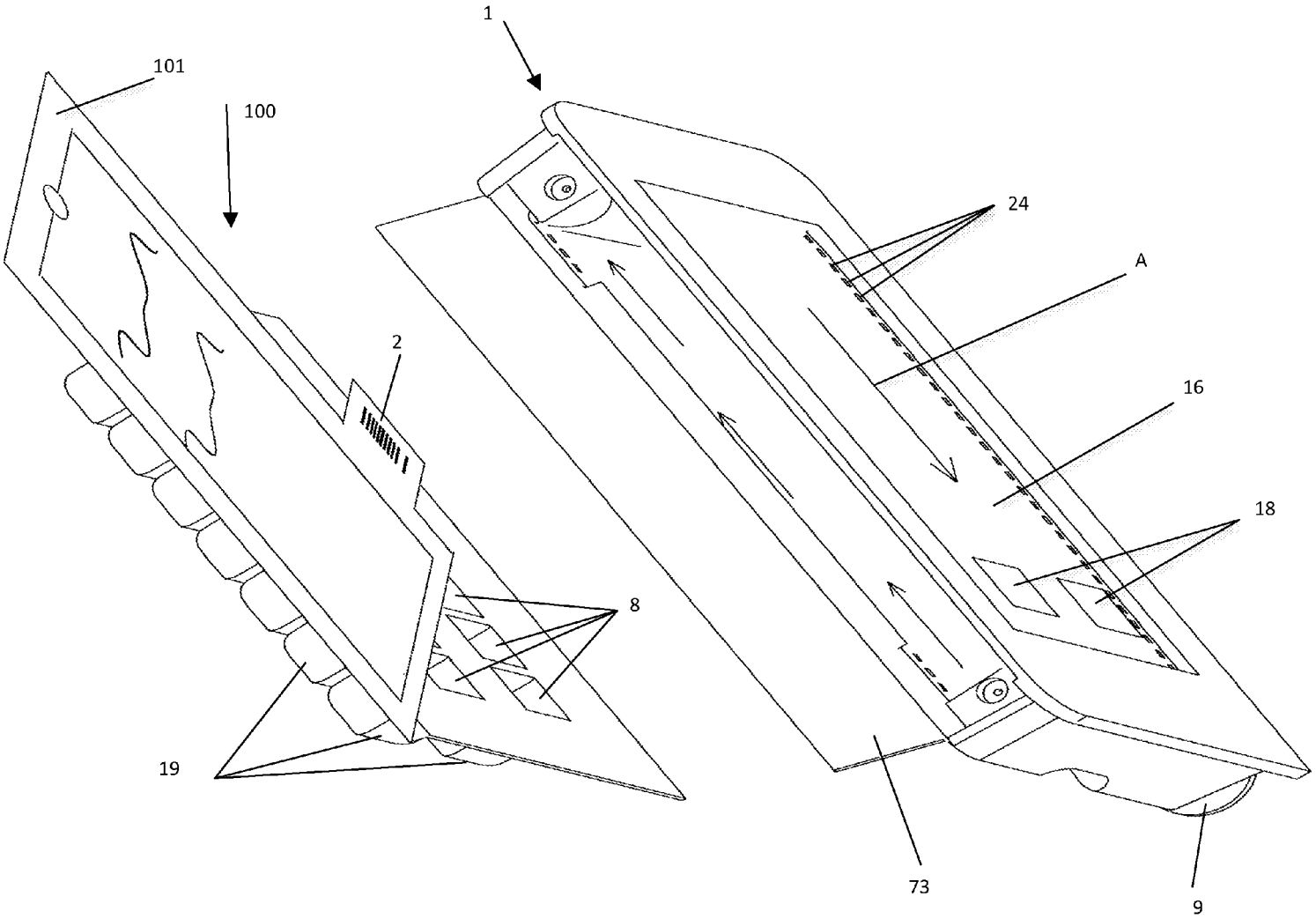
FIG. 5 is a perspective view of an embodiment of a cassette and an exemplary multi-compartment cartridge.

Referring now to FIG. 5, an embodiment of a cassette (1) and a cartridge (100) are depicted. Cartridge (100) may be of the type that may be remotely packaged and/or processed, such as at a pharmacy, for example, and/or mailed or delivered to a recipient. For example, a user's medical information and/or pharmaceutical needs may be sent to a pharmacy, the pharmacy may fill cartridge (100) and/or compartments (8) per a prescription, a doctor or nurse's orders, a certain regimen based on a diagnosis, etc., and the filled cartridge may be sent to a user. The user may insert cartridge (100) into cassette (1) for dispensing such as, for example, as described above and/or below. In some embodiments, cassette (1) may include a door or panel (73), which may be openable and/or closable to, for example, facilitate insertion, removal, and/or retention of cartridge (100) in or from cassette (1). In some embodiments, cartridge (100) may include a cover (101), which may include barcode (2), and/or which may be removable at any time, such as before insertion into cassette (1), although cover (101) or any associated feature is optional and not required.

Figure 6:
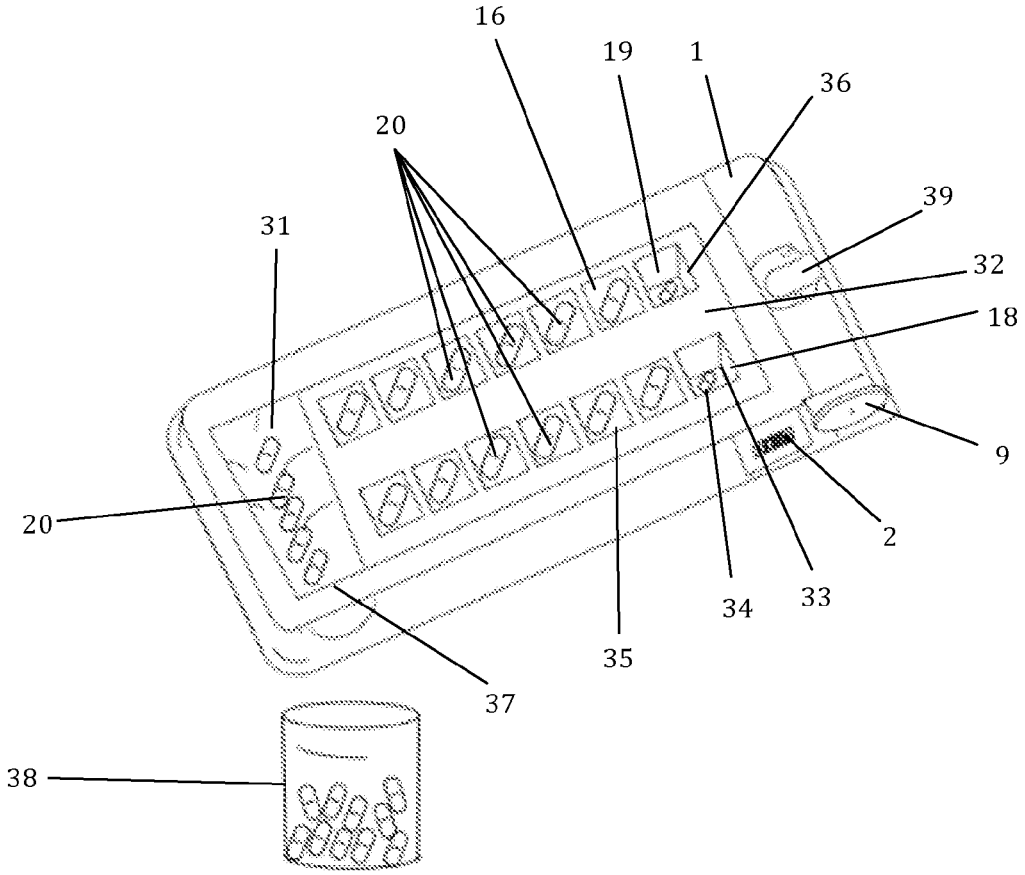
FIG. 6 is a perspective view of an alternative embodiment of a cassette and an exemplary multi-compartment cartridge with contents therein.

Referring now to FIG. 6, an alternative embodiment of cassette (1) is depicted. This embodiment of cassette (1) may, among other things, facilitate loading of compartments (8) and/or towers (19). For example, contents (20) may be poured or otherwise placed into recessed area (31). Contents (20) may slide along or over an outer surface (32) and/or film (16), and/or placed over towers (19). Locating apertures (18) of film (16) over towers (19), as indicated by position (33) may allow contents (20) to fall into towers (19) as they become aligned with apertures (18), as indicated by retained contents (34), for example. Movement of film (16) to a position (35) may cause retained contents (34) located at position (36) to become sealed inside tower (19) by film (16) or a portion thereof not containing apertures (18). A thumb groove (39) or similar structure can be used, for example, to lift cassette (1) and/or pour contents (20) from cassette (1) through a funnel (37) and into a container or bottle (38).

In use, a user or other individual, person, and/or entity may provide a cartridge (100) that is preloaded with contents (20), such as described above, and may insert the cartridge (100) into cassette (1) having an actuatable member such as first wheel (9) and/or other actuatable member, such as described above. Cassette (1) may include film (16) having one or more apertures (18) through which contents (20) may pass. Cassette (1) may be attached to housing (3), such as is described above, first wheel (9) may be actuated to cause rotation, translation, and/or movement of film (16) so that apertures (18) may be aligned with compartments (8). Alignment of apertures (18) with compartments (8) may cause dispensing of at least a portion of contents (20) through apertures (18), such as is described above.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and embodiments has been presented for purposes of illustration. It is not intended to be exhaustive or to limit the precise steps and/or forms disclosed, and obviously many modifications and variations are possible in light of the above teaching. It is intended that the scope and all equivalents be defined by the claims appended hereto.

What is claimed is:

1. A metered dispenser, comprising:

a cassette sized and shaped to internally receive a predetermined multi-compartment cartridge, each compartment of said multi-compartment cartridge suitable for retaining a pre-determined object;

said cassette receivable in a housing;

an actuatable film attached to and wrapped around said cassette, said film having a film aperture through which at least one said pre-determined object may pass;

said film actuatable between a closed position, a first open position, and a second open position;

wherein in said first open position said film aperture is selectively alignable with a first compartment of said multi-compartment cartridge while in said cassette, and in said second open position said film aperture is selectively alignable with a second compartment of said multi-compartment cartridge while in said cassette;

said cassette including a first actuatable member causing actuation of said film between said closed position, said first open position, and said second open position; and said housing including a second actuatable member causing actuation of said first actuatable member;

wherein said housing includes a scale for measuring and communicating the weight of said predetermined objects.

2. The metered dispenser of claim 1, wherein said first actuatable member of said housing is in communication with a timer to automatically actuate said film.

3. The metered dispenser of claim 1, wherein said housing includes an angled surface to direct said pre-determined object toward an accessible area.

4. The metered dispenser of claim 1, wherein an indication is made if said weight of said predetermined objects differs from a predetermined target weight.

5. The metered dispenser of claim 1, wherein said predetermined object includes a plurality of pills.

6. The metered dispenser of claim 1, wherein at least one of said first actuatable member and said second actuatable member is a wheel.

7. The metered dispenser of claim 6, wherein both of said first actuatable member and said second actuatable member are cooperating wheels.

8. The metered pill dispenser of claim 1, wherein said cassette includes a door that is openable to receive said cartridge and closable to retain said cartridge in said cassette.

9. A metered dispenser, comprising:

a cassette sized and shaped to internally receive a predetermined multi-compartment cartridge, each compartment of said multi-compartment cartridge suitable for retaining a pre-determined object;

said cassette receivable in a housing;

an actuatable film attached to and wrapped around said cassette, said film having a film aperture through which at least one said pre-determined object may pass;

said film actuatable between a closed position, a first open position, and a second open position;

wherein in said first open position said film aperture is selectively alignable with a first compartment of said multi-compartment cartridge while in said cassette, and in said second open position said film aperture is selectively alignable with a second compartment of said multi-compartment cartridge while in said cassette;

said cassette including a first actuatable member causing actuation of said film between said closed position, said first open position, and said second open position; and said housing including a second actuatable member causing actuation of said first actuatable member;

wherein at least one of said cassette and said housing include a recessed area for receiving said predetermined objects;

wherein said recessed area includes a funnel.

10. The metered dispenser of claim 1, wherein said second actuatable member of said housing is in communication with a control.

11. The metered dispenser of claim 10, further comprising a camera for reading a readable identifier and communicating said readable identifier to said at least one of said control and said user device.

12. The metered dispenser of claim 1, wherein said control is in communication with a device having a user interface for causing actuation of said first actuatable member via said control.

13. The metered dispenser of claim 12, wherein said cartridge includes a readable identifier identifying contents of said cartridge, and said readable identifier is in communication with at least one of said control and said user device.

14. The metered dispenser of claim 13, wherein said user device is at least one of a cell phone and a tablet device.

15. A metered dispenser, comprising:

a cassette shaped to receive a pre-determined multi-compartment cartridge, each compartment of said multi-compartment cartridge suitable for retaining a pre-determined object;

said cassette receivable in a housing;

an actuatable film attached to and wrapped around said cassette, said film having a film aperture through which at least one said pre-determined object may pass;

said film actuatable between a closed position, a first open position, and a second open position;

wherein in said first open position said film aperture is selectively alignable with a first compartment of said multi-compartment cartridge while in said cassette, and in said second open position said film aperture is selectively alignable with a second compartment of said multi-compartment cartridge while in said cassette;

said cassette including a first actuatable member causing actuation of said film between said closed position, said first open position, and said second open position; and said housing including a second actuatable member causing actuation of said first actuatable member;

said cassette includes a recessed area for receiving said predetermined objects, said recessed area acting as a funnel for pouring out contents of said recessed area.

* * * * *